US007163272B2

(12) United States Patent
Parish et al.

(10) Patent No.: US 7,163,272 B2
(45) Date of Patent: Jan. 16, 2007

(54) INKJET PRINT HEAD

(75) Inventors: George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 251 days.

(21) Appl. No.: 10/865,655

(22) Filed: Jun. 10, 2004

(65) Prior Publication Data

US 2005/0275676 A1 Dec. 15, 2005

(51) Int. Cl.
*B41J 29/38* (2006.01)

(52) U.S. Cl. ..... 347/17; 347/14

(58) Field of Classification Search ..... 347/17
See application file for complete search history.

(56) References Cited

U.S. PATENT DOCUMENTS 6,382,773 B1 5/2002 Chang et al.
6,612,673 B1 * 9/2003 Giere et al. ..... 347/17
6,634,731 B1 10/2003 Kao et al.
2001/0004263 A1 * 6/2001 Ishinaga et al. ..... 347/17
2002/0027574 A1 3/2002 Kao et al.
2002/0052932 A1 5/2002 Curtis et al.
2003/0081034 A1 * 5/2003 Bauer ..... 347/17
2003/0142159 A1 * 7/2003 Askeland et al. ..... 347/14

* cited by examiner

*Primary Examiner*—Stephen Meier
*Assistant Examiner*—Jannelle M. Lebron
(74) *Attorney, Agent, or Firm*—King & Schickli, PLLC

(57) ABSTRACT

Some embodiments of the present invention provide an inkjet print head having a housing defining an ink reservoir, a nozzle portion including a nozzle plate defining an ink chamber in fluid communication with the ink reservoir, and forming a fluid flow path between the ink chamber and the ink reservoir, and a substrate coupled to the nozzle plate and having a surface substantially positioned over the nozzle plate. At least one heating element can be coupled to the substrate, and can be positioned adjacent the surface to heat a portion of the ink chamber. In some embodiments, the inkjet print head comprises a control circuit coupled to the at least one heating element for controlling the heating element, and a temperature sense element positioned substantially between the at least one heating element and the control circuit or in at least partially overlapping relationship with the heating element.

9 Claims, 3 Drawing Sheets

10

10

INKJET PRINT HEAD

BACKGROUND OF THE INVENTION

The present invention generally relates to printing apparatus and in some embodiments, more particularly, to inkjet printers.

Inkjet print heads typically require a well-controlled substrate temperature to maintain a consistent ink viscosity and jetting performance. Currently, inkjet print heads include a temperature sense resistor (TSR) integrated into a chip to monitor the substrate temperature. The chip can also have dedicated power field effect transistors (FETs) to control the heating elements, as in U.S. Pat. No. 6,102,515 which is hereby incorporated by reference insofar as it relates to the use of FETs to control heating elements in print heads. In some examples, a printer control unit periodically monitors the TSR(s) to determine the substrate temperature. Then, the control unit turns heating elements on and off, accordingly, to maintain the proper substrate temperature for optimum jetting performance.

SUMMARY OF THE INVENTION

In some conventional print head designs, the positions of one or more TSRs can interfere with fluid flow to the heater nozzle of the print head (e.g., presenting detrimental topographical effects when placed over the fluid flow paths). Also, some print heads have TSRs that are located sufficiently far from the heating elements (which are typically positioned over portions of the ink flow) to generate inaccurate temperature readings in some conditions.

In some embodiments of the present invention, one or more temperature sense elements can be positioned with respect to the inkjet print head such that the temperature sense element(s) can provide accurate temperature readings while not interfering with ink flow or while providing reduced interference with ink flow. In some embodiments, the temperature sense elements include TSRs.

Some embodiments of the present invention provide an inkjet print head including a substrate, and comprising at least one actuator positioned proximate to a surface of the substrate; a control circuit coupled to the at least one actuator for controlling the actuator; and a temperature sense element positioned substantially between the at least one actuator and the control circuit.

In some embodiments, an inkjet print head is provided, and comprises at least one actuator positioned proximate to a surface of a substrate; and a temperature sense element embedded in the substrate and positioned such that at least a portion of the temperature sense element is in substantial overlapping relationship with at least a portion of the at least one actuator.

Some embodiments of the present invention provide an inkjet print head comprising a first plurality of heating elements forming a first heating array, the first heating array positioned to heat ink in at least a portion of a first plurality of ink chambers; a second plurality of heating elements forming a second heating array, the second heating array positioned to heat ink in at least a portion of a second plurality of ink chambers; a first control circuit coupled to the first heating array for controlling the first heating array; a second control circuit coupled to the second heating array for controlling the second heating array; a first temperature sense element positioned substantially between the first heating array and the first control circuit; and a second temperature sense element positioned substantially between the second heating array and the second control circuit.

In some embodiments, a method of controlling a temperature of an inkjet print head having a control circuit operatively coupled to a temperature sense element is provided, and comprises: heating ink in an ink chamber with a heater; and sensing a temperature of a substrate with the temperature sense element in at least one of a first location substantially between the control circuit and the heater and a second location in which the temperature sense element at least partially overlaps the heater.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof, and can include additional items. The terms "mounted," "connected" and "coupled" are used broadly and encompass both direct and indirect mounting, connecting and coupling. Further, "connected" and "coupled" are not restricted to physical or mechanical connections or couplings.

Figure 1:
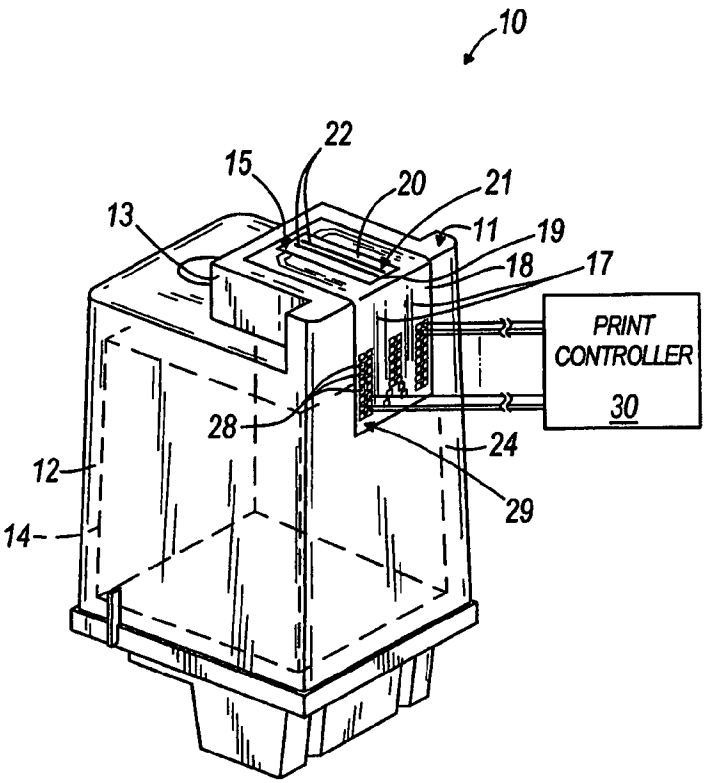
FIG. 1 is a perspective view of an inkjet print head.

FIG. 1 illustrates an inkjet print head 10 having a housing 12 that defines a nosepiece 13 and an ink reservoir 14 containing ink or an insert (e.g., a foam insert or other fluid-retaining insert) saturated with ink. The inkjet print head 10 illustrated in FIG. 1 has been inverted to illustrate a nozzle portion 15 of the print head 10. The nozzle portion 15 is located at least partially on a bottom surface 111 of the nosepiece 13 for transferring ink from the ink reservoir 14 onto a printing medium, such as, for example, paper (including without limitation stock paper, stationary, tissue paper, homemade paper, and the like), film, tape, photo paper, a combination thereof, and any other medium used or usable in inkjet printing apparatus. The nozzle portion 15 can include a substrate (e.g., a chip 16, not visible in FIG. 1) and a nozzle plate 20 having a plurality of nozzles 22 that define a nozzle arrangement and from which ink drops are ejected onto a printing medium that is advanced through a printing apparatus (not shown).

The chip 16 can be formed of a variety of materials including, without limitation, various forms of doped or non-doped silicon, doped or non-doped germanium, or any other semiconducting material. In some embodiments, the chip 16 is positioned to be in electrical communication with conductive traces 17 provided on an underside of a tape member 18. The chip 16 is hidden from view in the assembled print head 10 illustrated in FIG. 1, and is attached to the nozzle plate 20 in a removed area or cutout portion 19 of the tape member 18 such that an outwardly facing surface 21 of the nozzle plate 20 is generally flush with and parallel to an outer surface 29 of the tape member 18 for directing ink onto a printing medium via the plurality of nozzles 22 in fluid communication with the ink reservoir 14. In other embodiments, the nozzle plate 20 can have different positions and orientations with respect to the tape member 18, or be formed from the tape member 18, while still falling within the spirit and scope of the present invention.

In the illustrated embodiment of FIG. 1, the tape member 18 is coupled to one side 24 of the housing 12 and the bottom surface 11 of the nosepiece 13, although in other embodiments the tape member 18 can be coupled to any other side or sides of the print head 10 enabling electrical connection between the chip 20 and the printer controller 30 (described below).

In some embodiments, the tape member 18 includes a plurality of conductive traces 17 that connecting the chip 16 (or various components included in the chip 16) to another circuit or device. For example, in some embodiments, each conductive trace 17 directly or indirectly connects at one end to an actuator, such as a heating element 32 or a piezo element (not shown), of the chip 16 and terminates at an opposite end at a contact pad 28. The contact pads 28 can be positioned to mate with or otherwise electrically connect to corresponding contacts on a carriage (not shown) for communication between a microprocessor-based printer controller 30 and components of the print head 10 (e.g., the heating elements 32). To be positioned in this manner in some embodiments, the contact pads 28 extend through the tape member 18 to the outer surface 29 of the tape member 18. In other embodiments, the contact pads 28 can be positioned on the tape member 18 in other manners enabling electrical connection to another circuit or device. In those embodiments of the present invention having a tape member 18, the tape member 18 can be formed of a variety of polymers or other materials capable of providing or carrying conductive traces 17 to electrically couple the nozzle portion 15 of the print head 10 to the contact pads 28 and the printer controller 30.

In other embodiments, the nozzle portion 15 of the print head 10 can be electrically coupled to another circuit or device without the use of a tape member 18 as described above. By way of example only, conductive traces 17 can be provided on a surface of the housing 12, and can extend between the chip 16 and contact pads 28 on the housing 12. As another example, any type and number of wires or other electrical leads can be coupled to the chip 16 and to one or more electrical connectors (e.g., pins, sockets, pads, and the like) on the print head 10, wherein the electrical connectors are adapted to be electrically coupled to another circuit or device (e.g., the printer controller 30). Still other manners of electrically coupling the nozzle portion 15 of the print head 10 and contact pads 38 or other electrical connectors are possible, and fall within the spirit and scope of the present invention.

Figure 2:
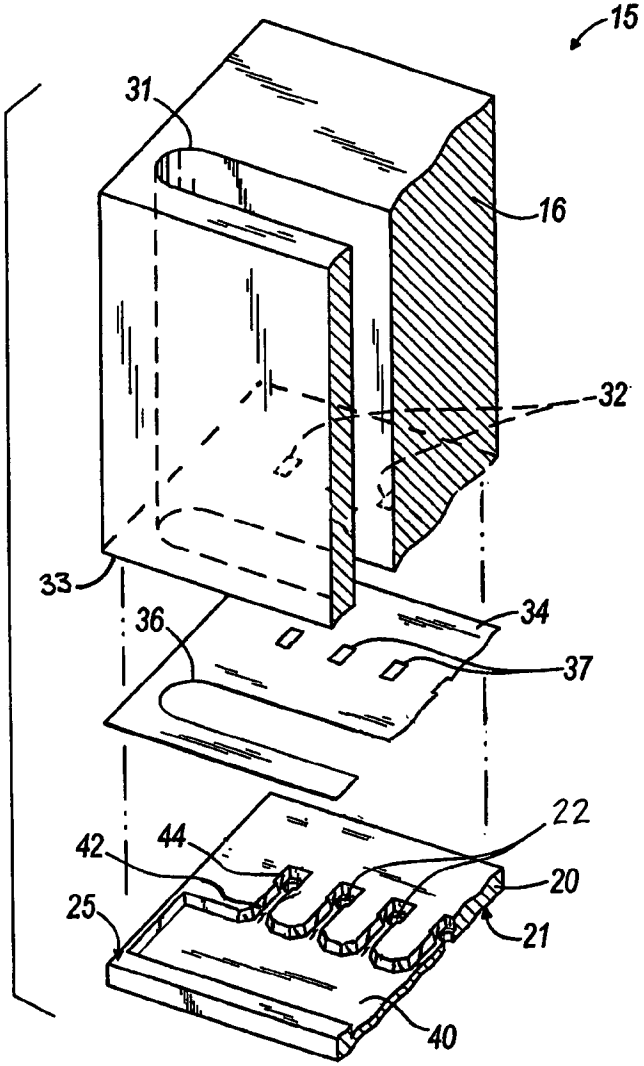
FIG. 2 is a partial exploded view of the print head illustrated in FIG. 1.

FIG. 2 illustrates an exploded view of the nozzle portion 15 of the print head 10 illustrated in FIG. 1. The nozzle portion 15 includes the chip 16, which in some embodiments defines an aperture 31. The chip 16 also includes a surface 33 and one or more heating elements 32. The heating elements 32 can be positioned on the surface 33 in any manner, such as by being coupled to the surface 33, printed on the surface 33, embedded within the surface 33 and chip 16, and the like. The nozzle portion 15 can further include the nozzle plate 20 coupled to the chip 16. When assembled, the surface 33 of the chip 16 is positioned substantially over the nozzle plate 20 (with reference to the orientation of the print head 10 as shown in FIG. 2).

Some embodiments of the present invention have a film 34 covering at least a portion of the chip 16. The film 34 can be positioned to protect circuitry of the chip 16 (e.g., components on the chip 16 necessary to maintain electrical connection between the heating element 32 and the printer controller 30) from corrosive properties of the ink. The film 34 can include an aperture 36 that corresponds with the aperture 31 of the chip 16, and can include one or more other apertures 37 corresponding to the heating elements 32 for purposes that will be described in greater detail below. The chip 16 and the film 34 (if used) are coupled to the housing 12 such that the apertures 31 and 36 collectively define an ink via, and fluidly communicate with the ink reservoir 14.

With continued reference to FIG. 2, in some embodiments the nozzle plate 20 includes a recess 40 in fluid communication with the ink reservoir 14 via the apertures 31 and 36 of the chip 16 and the film 34, respectively. The nozzle plate 20 can further include a plurality of channels 42, each channel 42 extending to a respective chamber 44 and in fluid communication with a respective nozzle 22. Any portion of at least one of the recess 40, a channel 42, a chamber 44, and a nozzle 22 can be collectively referred to as "flow features." In some embodiments, the nozzle plate 20 can include more or fewer channels 42 and chambers 44 than shown in the illustrated embodiments. In some embodiments, one or more channels 42 can connect (e.g., flow) to multiple chambers 44. Also, the chambers 44 and/or channels 42 can be different in size, shape and/or uniformity in other embodiments of the present invention.

Ink can travel (e.g., by gravity and/or capillary action) from the ink reservoir 14 in the housing 12 through the apertures 31 and 36, into the recess 40, into the plurality of channels 42, and into the plurality of chambers 44.

In some embodiments of the present invention, the heating elements 32 are positioned on the chip 16 adjacent the chambers 44. In some embodiments, the heating elements 32 can include any element capable of converting electrical energy into heat, such as a transducer or resistor. For example, in some embodiments (including the embodiment illustrated in FIGS. 1 and 2), the heating elements 32 can be thin-film resistors. Electrical signals sent from the printer controller 30 to the heating elements 32 (e.g., via the conductive traces 17 of the tape member 18) can heat the heating elements 32 and vaporize ink in the chambers 44.

In the illustrated embodiment of FIGS. 1 and 2, the heating elements 32 are exposed to the chambers 44 through the apertures 37 in the film 34 (if used). As a result, when one or more electrical signals are sent from the printer controller 30 to actuate (e.g., heat) a heating element 32, the heating element 32 heats a thin layer of ink in the adjacent chamber 44, thereby vaporizing a volatile component of the ink and ejecting a portion of the ink occupying the chamber 44 out of the adjacent nozzle 22 in the form of an ink droplet (or drop), which can strike a desired location of a printing medium. The chamber 44 can subsequently refill with ink (e.g., by capillary action) in order to prime the chamber 44 for subsequent printing.

Figure 3:
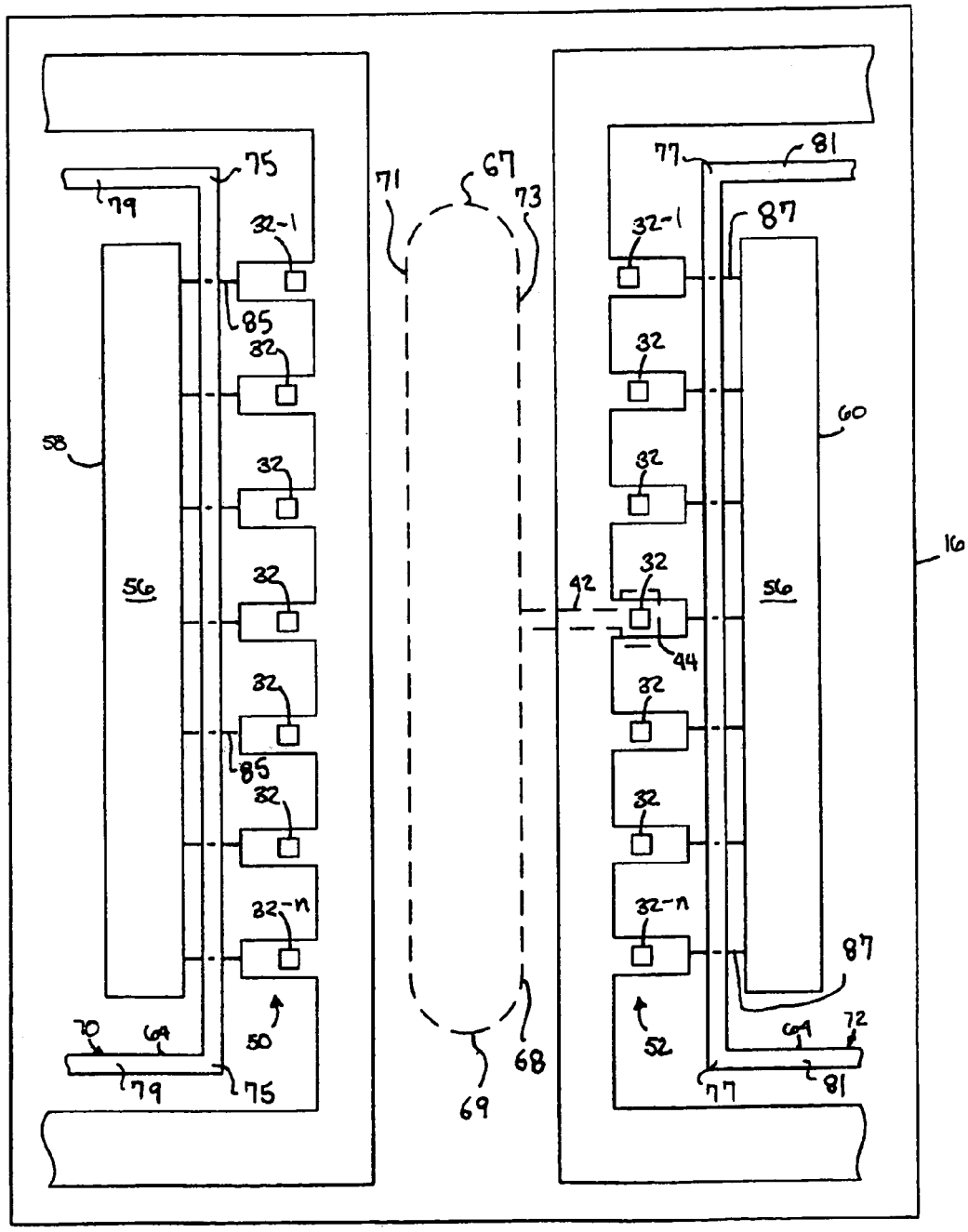
FIG. 3 is a plan view of a portion of an inkjet print head according to one embodiment.
Figure 4:
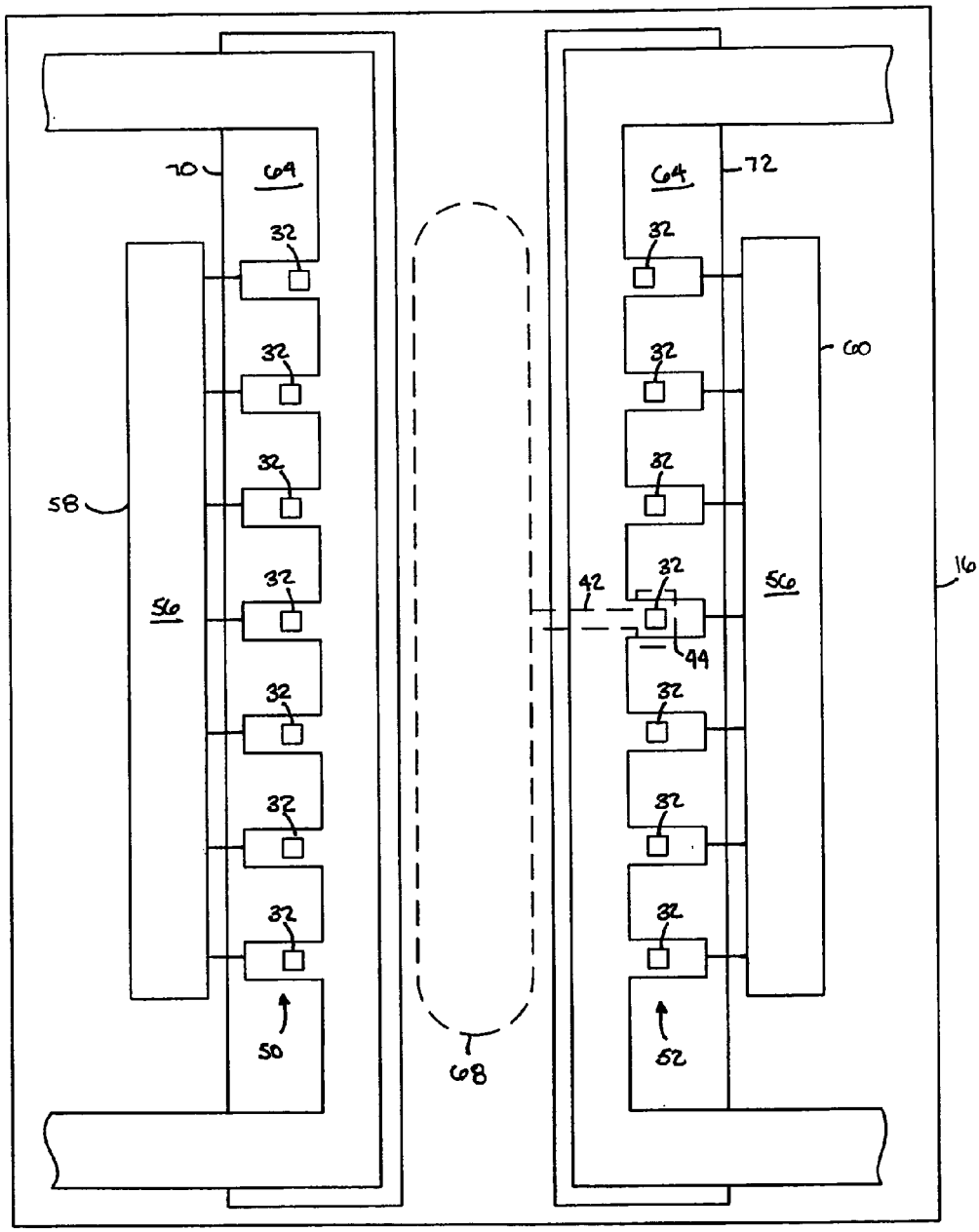
FIG. 4 is a plan view of a portion of an inkjet print head according to another embodiment.

A portion of the inkjet print head 10, particularly the substrate (e.g., chip) 16, is illustrated in FIGS. 3 and 4. In the illustrated embodiments, the heating elements 32 are arranged into a first heating array 50 and a second heating array 52. In other embodiments (not shown), the heating elements 32 can be arranged in more or fewer arrays than shown in the illustrated embodiment. The arrays 50 illustrated in FIGS. 3 and 4 are each a row of heating elements 32. However, in other embodiments, the heating elements 32 can be located in other manners, such as in blocks, in staggered arrangements, or in any other regular or irregular manner.

The chip 16 illustrated in both embodiments of FIGS. 3 and 4 further includes control circuits 56 for controlling and activating the heating elements 32. Any number of control circuits 56 can be used for this purpose, each of which can control and activate any number of heating elements 32. In the illustrated embodiments of FIGS. 3 and 4, for example, two control circuits 56 are used, each of which controls an array 50 of heating elements 32. In other embodiments, a single control circuit 56 controls and activates all of the heating elements 32. In still other embodiments, multiple control circuits 56 perform this function, each controlling and activating one or more heating elements 32.

In some embodiments, the control circuit 56 can include one or more field effect transistors (FETs) activating one or more heating elements 32. For example, the control circuit 56 can include a power FET for each heating element 32. In other embodiments, the chip 16 can include a control circuit 56 for each heating array 50 or 52, and each control circuit 56 can include a bank of power FETs (not shown), one FET for each heating element 32 of the array 50 or 52. In the illustrated embodiments of FIGS. 3 and 4, the chip 16 includes a first control circuit 58 for activating the first heating array 50 and a second control circuit 60 for activating the second heating array 52.

The chip 16 further includes at least one temperature sense element positioned to sense a temperature of a location on the print head 10. In some embodiments, the temperature sense element is or comprises a temperature sense resistor (TSR) 64. The TSR 64 can include a polysilicon material or another material responsive to temperature. For example, the TSR 64 can include a N-type source drain (NSD) material, a N-well layer material, a P-type source drain (PSD) material, a lightly doped drain (LDD) material or another suitable material. In some embodiments, the TSR 64 can be approximately 0.05 μm to approximately 5000 μm wide, by approximately 0.01 μm to approximately 400,000 μm long, by approximately 0.05 μm to approximately 4 μm thick.

In some embodiments, the TSR 64 senses the temperature of the chip 16, one or more of the heating elements 32, the ink chamber 44, or other location of the print head 10 and provides this information to the printer controller 30 or another circuit. The printer controller 30 or other circuit can use the temperature information provided by the TSR 64 when configuring activation of the heating elements 32. In some embodiments, the TSR 64 is positioned such that the TSR 64 is in close proximity to one or more of the heating elements 32 without disrupting ink flow. In other words, the TSR 64 is not located in a position that would compromise ink flow from the ink via 68 through the channels 42 to the ink chamber 44. The via 68, one of the channels 42, and one of the ink chambers 44 is shown in dashed lines in FIGS. 3 and 4.

In the embodiment illustrated in FIG. 3, a first TSR 70 is located between the first control circuit 58 and the first heating array 50, and is in a position away from the fluid flow paths (e.g., the paths from ink via 68 through channel 42 to ink chamber 44 as described above), and a second TSR 72 is placed between the second control circuit 60 and the second heating array 52, and is also in a position away from the fluid flow paths. The positions of the first TSR 70 and the second TSR 72 enable the TSRs 70, 72 to be located in relatively close proximity to the heating elements 32 without detrimental topography effects to fluid flow compared to other positions (e.g., on the opposite side of the heating elements 32, where the TSRs 70, 72 would otherwise overlap the fluid flow paths).

As is seen, the TSR's 70, 72 have a longitudinal extent that is substantially parallel along and to an entire length of arrays 50, 52, respectively, such as between individual heating elements 32-1 and 32-n. In turn, the array of actuators substantially parallel the longitudinal extent of the ink via 68 on either sides 71, 73 thereof, so that each of the ink chambers 44 and ink channels 42 can be respectively of nearly uniform size and shape and have commonality all along a length of the via. Also, the TSR's have a fairly straight length along the length of the arrays that extends beyond terminal ends 67, 69 of the ink via and beyond a length of the arrays. In this manner, each TSR is able to sense local heating per an entire array and not just a portion thereof. Also, the ink via itself acts as a thermal insulator between each array 50, 52 so that temperature readings of TSR's 70, 72 are not unduly influenced by heating elements 32 on an opposite side of the ink via. Beyond the array, TSR's 70, 72 bend orthogonally to its longitudinal extent at positions 75, 77so that it can be directed at positions 79, 81 around the control circuitry 56 and away from the arrays. In no instance, however, do the TSR's overlap the fluid flow paths or flow features, as before. Appreciating the chip 16 is formed as many layers, the lack of overlap between the TSR's and the fluid flow paths or features occurs in either of the vertical directions of the chip such as into or away from the paper of the figure according to traditional arrow symbols ⊙ (into) or ⊕ (away). There is vertical overlap, however, between the TSR's 70, 72 and one or more electrical traces 85, 87, as is seen, that electrically connect the control circuits 56 to either of the arrays 50, 52.

In the embodiment illustrated in FIG. 4, the first TSR 70 is positioned beneath the first heating array 50, and the second TSR 72 is positioned beneath the second heating array 52. In other words, the first TSR 70 and the second TSR 72 can be embedded into the chip 16. In some embodiments, the TSR 64 is embedded into the chip 16 such that the TSR 64 is still adjacent the surface 33 of the chip 16, and may or may not be positioned over one or more ink chambers 44 or one or more ink channels 42. In some embodiments, a thin layer (not shown) of the substrate 16 can separate the TSR 64 and any overlapping ink channels 42 or ink chambers 44, which can eliminate topography issues presented from placing a TSR 64 directly over an ink channel 42 or chamber 44. In the embodiment of FIG. 4, the TSR 70 includes an implanted material in the chip 16, such as, for example, a NSD material, a PSD material or a N-well material. Implanted TSRs 64 can be used without presenting any topography issues that can effect fluid flow as described above.

In other embodiments (not shown), the chip 16 can include more or fewer TSRs 64 than the embodiments illustrated in FIGS. 3 and 4. For example, the chip 16 can include a dedicated TSR 64 located as described above for each heating element 32, or can include one TSR 64 located as described above for multiple heating elements 32. In some embodiments, the chip 16 can also include various combinations of different positions of TSRs 64. For example, a chip 16 can include a TSR 64 positioned between the control circuit 56 and the heating elements 32, away from the fluid flow paths (as shown in FIG. 3) as well as one or more implanted TSRs 64 positioned beneath one or more heating elements 32 (as shown in FIG. 4).

In some embodiments, (not shown), the chip 16 can include additional heating elements 32 dedicated to heating the substrate (e.g., chip 16) as opposed to the ink in the ink chambers 44. The chip 16 can further include one or more TSRs 64 for providing temperature readings for these additional substrate heating elements. In still further embodiments (not shown), the heating arrays 50 and 52 can further include one or more substrate heating elements (e.g., heating elements dedicated to heating the substrate as opposed to an ink chamber) in addition to the heating elements 32 heating the ink chambers 44.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the present invention can be used in conjunction with inkjet print heads 10 having shapes that are different than that shown in FIG. 1 (e.g., print heads 10 not having a nozzle portion 13 shaped as shown, print heads 10 having other dimensions and features, and the like).

The invention claimed is:

1. An inkjet print head including a substrate, comprising:

an ink via having a longitudinal extent;

an array of actuators substantially paralleling the longitudinal extent of the ink via, each of the actuators positioned proximate to a surface of the substrate;

a control circuit coupled to the array of actuators for controlling the each of the actuators; and a temperature sense element positioned substantially between the array of actuators and the control circuit, the temperature sense element having a longitudinal extent that is substantially parallel along and to an entire length of the array of actuators.

2. The inkjet print head as set forth in claim 1, and further comprising a plurality of ink chambers, each ink chamber being in fluid communication with an ink reservoir, and the plurality of ink chambers and the ink reservoir form a plurality of fluid flow paths;

a plurality of actuators in the array positioned proximate the surface, said each actuator positioned to eject a portion of ink from a respective one of the plurality of ink chambers; and wherein the control circuit is coupled to the plurality of actuators for controlling each of the plurality of actuators and the temperature sense element has no vertical overlap with the fluid flow paths.

3. The inkjet print head as set forth in claim 2, and further comprising a plurality of temperature sense elements, each temperature sense element positioned substantially between at least one of the plurality of actuators and the control circuit.

4. The inkjet print head as set forth in claim 3, and wherein the control circuit includes a plurality of field effect transistors, each field effect transistor is coupled to one of the plurality of actuators for controlling the actuators.

5. The inkjet print head as set forth in claim 2, and wherein the control circuit includes a plurality of field effect transistors, each field effect transistor is coupled to one of the plurality of actuators for controlling the actuators.

6. The inkjet print head as set forth in claim 1, and further comprising a second array of actuators, a second control circuit coupled to the second array of actuators for controlling each of the actuators in the second array; and a second temperature sense element positioned substantially between the second array of actuators and the second control circuit.

7. The inkjet print head as set forth in claim 1, and wherein the temperature sense element comprises a polysilicon material.

8. The inkjet print head as set forth in claim 7, and wherein the temperature sense element comprises one of a N-type source drain (NSD) material, a N-well layer material, a P-type source drain (PSD) material and a lightly doped drain (LDD) material.

9. An inkjet print head comprising:

a first plurality of heating elements forming a first heating array, the first heating array positioned to heat ink in at least a portion of a first plurality of ink chambers;

a second plurality of heating elements forming a second heating array, the second heating array positioned to heat ink in at least a portion of a second plurality of ink chambers;

a first control circuit coupled to the first heating array for controlling the first heating array;

a second control circuit coupled to the second heating array for controlling the second heating array;

a first temperature sense element positioned substantially between the first heating array and the first control circuit; and a second temperature sense element positioned substantially between the second heating array and the second control circuit, each of the first and second temperature sense elements having a longitudinal extent that is substantially parallel along and to a respective entire length of the first and second heating arrays.

* * * * *